US006563052B2

(12) United States Patent
Groegl et al.

(10) Patent No.: US 6,563,052 B2
(45) Date of Patent: May 13, 2003

(54) ELECTRIC INSTALLATION CABLE

(75) Inventors: Ferdinand Groegl, Nuremberg (DE); Reinhold Goeblmaier, Fuerth (DE)

(73) Assignee: NEXANS, Paris (FR)

( * ) Notice: Subject to any disclaimer, the term of this patent is extended or adjusted under 35 U.S.C. 154(b) by 0 days.

(21) Appl. No.: 09/957,067

(22) Filed: Sep. 21, 2001

(65) Prior Publication Data

US 2002/0036096 A1 Mar. 28, 2002

(30) Foreign Application Priority Data

Sep. 23, 2000 (DE) ..... 200 16 527

(51) Int. Cl.[7] ..... H01B 7/00
(52) U.S. Cl. ..... 174/106 R; 174/113 R
(58) Field of Search ..... 174/106 R, 108, 174/110 F, 36, 113 R

(56) References Cited

U.S. PATENT DOCUMENTS 3,586,751 A * 6/1971 Schoerner ..... 174/113 R
3,610,814 A * 10/1971 Peacock ..... 174/110 PM
3,921,381 A * 11/1975 Vogelsberg ..... 174/32
3,944,717 A * 3/1976 Hacker et al. ..... 106/18.23
4,288,107 A * 9/1981 Schwartze ..... 285/137 R
4,691,081 A * 9/1987 Gupta et al. ..... 174/105 R
5,444,184 A * 8/1995 Hassel ..... 174/113 C
5,562,985 A * 10/1996 Sano et al. ..... 174/110 E
6,169,251 B1 * 1/2001 Grant et al. ..... 174/113 C
6,246,006 B1 * 6/2001 Hardin et al. ..... 174/106 R
6,297,454 B1 * 10/2001 Gareis ..... 174/113 C

FOREIGN PATENT DOCUMENTS

EP 0 559 941 A1 9/1993
WO WO 98/33189 7/1998

* cited by examiner

*Primary Examiner*—Chau N. Nguyen
(74) *Attorney, Agent, or Firm*—Sughrue Mion, PLLC

(57) ABSTRACT

An electric installation cable in which the insulated wires forming the core and serving to conduct electricity are bound together as one unit. For the simultaneous, undisturbed utilization of the cable for high frequency signals, the unit is made up of 4 cores (A) bound together to form a star-quad. A shield (3) made up of a plastic film (8) coated on both sides with aluminum is arranged over the cores (A). Tinned copper wires (4) are wrapped around the shield (3) to function as a ground wire (4) and a coat (5) of insulation material is arranged around the tinned copper wires (4).

7 Claims, 1 Drawing Sheet

ELECTRIC INSTALLATION CABLE

This application is based on and claims the benefit of German Patent Application No. 200 16 527.5 filed Sep. 23, 2000, which is incorporated by reference herein.

BACKGROUND OF THE INVENTION

The invention relates to an electric installation cable, in which the insulated wires forming the core and serving to conduct electricity are bound together as one unit.

A wide variety of such cables have been used for many years anywhere an electric current is required. In this context the cables have been used in all types of buildings and for supplying power to stationary and movable electric machines. Cables usually have three or more cores, one of which normally functions as an insulated ground wire. As long as the cables are used exclusively to transfer electricity, no problems occur with appropriate handling. However, the use of such cables to transfer high frequency telecommunications signals and data in today's ever-advancing technology is limited, since their impedence is too irregular for such purposes.

SUMMARY OF THE INVENTION

The task of the present invention is therefore to develop the cable described above so that it is also suitable without limitation for the undisturbed transfer of telecommunications signals.

This task is solved in accordance with the present invention in that

- the unit comprises four core wires bound together to form a star-quad,
- the core wires are shielded by a plastic film coated on both sides with aluminum,
- tinned copper wires functioning as ground wires are bound around the shield and
- a coat of insulation material is placed over the tinned copper wires.

Such a cable is designed symmetrically in the form of a star-quad. It thus has a regular cable impedance of, for example, 100 ohms at 1 MHz. Because of the symmetry of the cable, high frequency signals can be transferred without trouble by two cable circuits arranged at right angles to one another. Also, due to the very regular cable impedance, there are no significant signal reflections. The shield surrounding the tinned copper wires—hereinafter referred to as a "ground wire"—also provides excellent shielding for the cable, even for higher frequencies in the 1 MHz range. The core wires are therefore protected against the influence of outside electromagnetic fields and no interference is given off from the cable. The ground wire surrounding all of the core wires also lends the cable an added level of security, since an immediate protective disconnection occurs if outside mechanical damage reaches the live wires.

The cable can be produced easily in a single process if the known S/Z binding with alternating direction of twist is used to bind the cores and the wires of the ground wire.

BRIEF DESCRIPTION OF THE DRAWINGS

Some sample implementations of the present invention are presented in the drawings, in which.

DETAILED DESCRIPTION OF THE INVENTION

Figure 1:
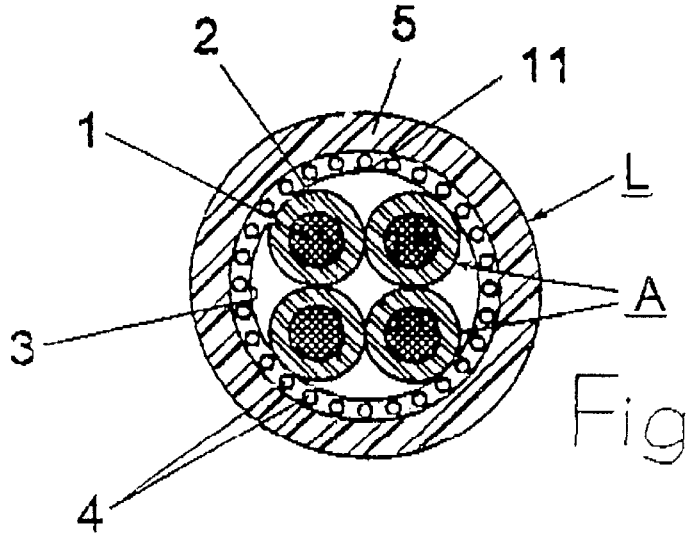
FIG. 1 shows a cross-section of a cable according to the present invention.

The electric installation cable L (cable L) according to FIG. 1 has four cores A, each of which consists of an electric cable 1 and an insulation 2 enclosing the same. In a preferred implementation, the cable 1 is a solid copper wire. The four cores A are bound together. They form a star-quad. An electrically effective shield 3 is arranged over the cores A, which is surrounded by a ground wire 4 consisting of tinned copper wires that are bound around the shield 3. A coat 5 of insulation is placed over the ground wire 4. It can consist, for example, of a halogen-free polymer or flame-resistant, low-smoke polyvinyl chloride.

Figure 2:
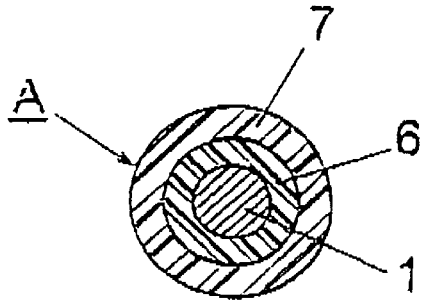
FIGS. 2 and 3 show an enlarged, detailed view of the cable.

Arranging the cores A in a star-quad results in a symmetrical construction of the cable L with a regular cable impedance. To further improve the transmission characteristics for telecommunications signals and to minimize the dimensions of the cable L, the insulation 2 of the cores A may consist of two layers 6 and 7 as shown in FIG. 2. In a preferred embodiment a reticulated polyolefin such as polyethylene is used for both layers 6 and 7. The inner layer 6 arranged adjacent to the cable 1 is solid by design. It guarantees the dielectric strength necessary for power transmission. The outer layer 7 consists of foamed material so that the dielectric constant of the insulation 2 is advantageously reduced. The outer layer 7 advantageously has a smooth surface (skin).

Figure 3:
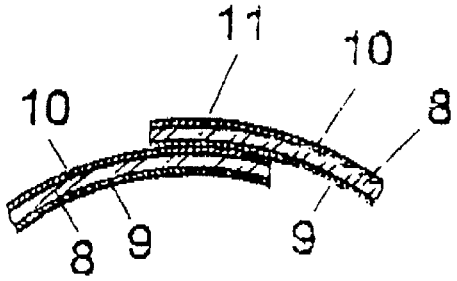

The shield 3 consists of a plastic film 8, which is coated on both sides with a firmly adhesive layer 9 as well as aluminum 10. In a preferred embodiment, polyester is used for the plastic film 8. It is, for example, approximately 0.13 mm thick. The two layers 9 and 10 made of aluminum are each at least 50 $\mu$m thick. In a preferred embodiment, the coated plastic film 8 is molded longitudinally around the cores A to form a tube with overlapping longitudinal branches. The overlap 11 (FIG. 3) is wide enough so that it results in a completely enclosed shield 3. In the overlap 11, the aluminum layers 9 and 10 lie directly against one another. However, the coated plastic film 8 can also be wrapped around the cores A as overlapping.

The ground wire 4 consists of tinned copper wires, which are bound around the shield 3 in a fixed manner with the greatest possible degree of coverage of the same. In a preferred embodiment, the ground wire 4 has two layers of tinned copper wires arranged one over the other.

The cores A and the tinned copper wires of the ground wire 4 can be spliced in a changing direction of twist (S/Z binding). This allows the possibility of producing the cable L in one continuous process. In a two-layer embodiment of the ground wire 4, the reversal points of the stranding are preferably in an axial direction relative to one another.

Before the shield 3 is molded around the cores A, an inner coat 12 (FIG. 4) can be extruded around the same, which fills the space between the cores A and serves as a surface for attaching the shield 3. However, it is also possible, as shown in FIG. 5, to first mold a plastic film 13 longitudinally around the cores A with an overlapping longitudinal edge. The overlap position 14 of the plastic film 13 is preferably set at a 180° angle to the overlapping 11 of the shield 3 in a circumferential direction.

Figure 4:
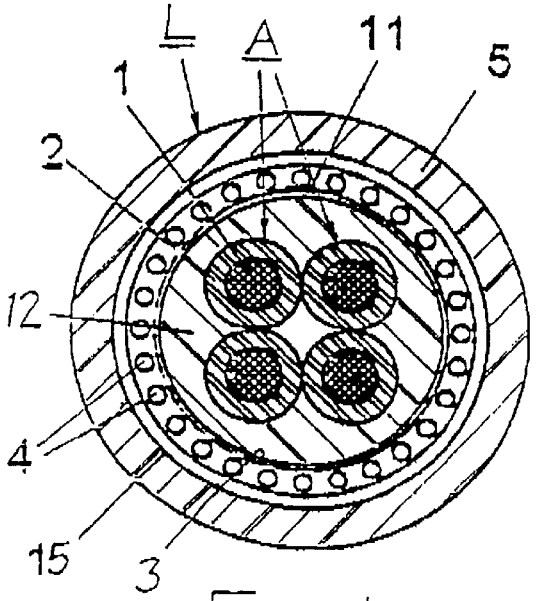
FIGS. 4 and 5 show two embodiments of the cable enhanced in comparison to FIG. 1, also in cross-section.
Figure 5:
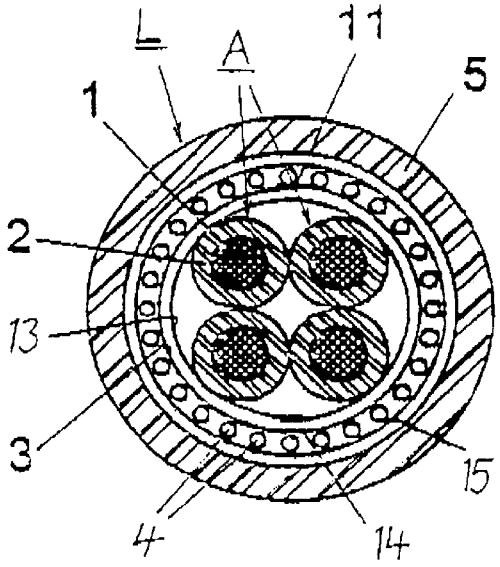

As shown in FIG. 4, it is useful to wrap a plastic film or a fiber fleece wrapping 15 around the ground wire 4. It holds the tinned copper wires of the ground wire 4 in their position and also prevents the material of the coat 5 from penetrating the ground wire 4 during extrusion.

What is claimed is:

1. An electric installation cable with a core, in which insulated conductors, each comprising a wire and a surrounding insulation, forming the core and serving to conduct electricity are bound together as one unit, characterized in that:

the unit comprises four of said insulated conductors (A) twisted together to form a star-quad;

the insulation (2) of the conductors (A) has an inner layer (6) made up of a cross-linked polyolefin and an outer layer (7) made up of a foamed, also cross-linked polyolefin;

an inner sheath (12) is extruded around the conductors (A);

the inner sheath (12) is surrounded by a shield (3) of plastic film (8) coated with aluminum on both sides;

tinned copper wires functioning as a ground wire (4) are twisted around the shield (3) in at least one layer; and the tinned copper wires (4) are surrounded by a jacket (5) made of insulating material.

2. A cable in accordance with claim 1, characterized in that the shield (3) is applied in a longitudinal direction with overlapping edges.

3. A cable in accordance with claim 1, characterized in that a plastic film (13) is formed around the conductors (A) in a longitudinal direction with overlapping.

4. A cable in accordance with claim 1, characterized in that a wrapping (15) is wound around the layer of tinned copper wires.

5. A cable in accordance with claim 4, characterized in that the wrapping (15) comprises a plastic film.

6. A cable in accordance with claim 4, characterized in that the wrapping (15) comprises a fiber fleece.

7. An installation, comprising:

a building comprising electric machines; and an electric installation cable installed in the building, the electric installation cable comprising a core in which insulated conductors, each comprising a wire and a surrounding insulation, forming the core and simultaneously conducting electricity and communications signals to the electric machines within the building, are bound together as one unit, characterized in that:

the unit comprises four of said insulated conductors (A) twisted together to form a star-quad;

the insulation (2) of the conductors (A) has an inner layer (6) made up of a cross-linked polyolefin and an outer layer (7) made up of a foamed, also cross-linked polyolefin;

an inner sheath (12) is extruded around the conductors (A);

the inner sheath (12) is surrounded by a shield (3) of plastic film (8) coated with aluminum on both sides;

tinned copper wires functioning as a ground wire (4) are twisted around the shield (3) in at least one layer; and the tinned copper wires (4) are surrounded by a jacket (5) made of insulating material.

* * * * *